US006089383A

United States Patent [19]

Heneveld

[11] Patent Number: 6,089,383

[45] Date of Patent: Jul. 18, 2000

[54] MULTIPLE USE STORAGE SHELF FOR ORGANIZING AND STORING SPORTING EQUIPMENT OR OTHER ARTICLES

[76] Inventor: William R. Heneveld, 431 Adaway Dr., SE., Grand Rapids, Mich. 49546

[21] Appl. No.: 09/251,279

[22] Filed: Feb. 16, 1999

Related U.S. Application Data

[63] Continuation of application No. 08/862,473, May 23, 1997, abandoned.

[51] Int. Cl.[7] ..... A47F 7/00; E04G 1/00

[52] U.S. Cl. ..... 211/14; 182/129; 211/70.6; 206/575; 206/315.9; 248/210; 248/238

[58] Field of Search ..... 211/70.6, 51, 214; 182/129; 248/210, 238; 206/315.9, 315.91, 576, 575

[56] References Cited

U.S. PATENT DOCUMENTS

| | | | |
|---|---|---|---|
| D. 198,349 | 6/1964 | Saunders | D80/10 |
| D. 260,830 | 9/1981 | Trouba | D6/125 |
| D. 342,854 | 1/1994 | Pentz | D6/552 |
| 2,855,107 | 10/1958 | Roth | 211/60 |
| 3,650,407 | 3/1972 | Benham, Jr. | 211/14 |
| 3,857,482 | 12/1974 | Shelton | 211/13 |
| 4,002,241 | 1/1977 | Parrilla, Sr. | 211/88 |
| 4,561,547 | 12/1985 | Estwanik, III | 211/14 |
| 4,583,647 | 4/1986 | Schinzing | 211/60.1 |
| 4,854,456 | 8/1989 | Lee | 211/14 |
| 4,936,467 | 6/1990 | Bobeczko | 211/14 |
| 4,949,925 | 8/1990 | Gorecki | 248/238 |
| 4,989,734 | 2/1991 | Mode et al. | 206/575 |
| 5,085,327 | 2/1992 | Mercer, Jr. et al. | 211/13 |
| 5,335,794 | 8/1994 | Reedy | 211/13 |
| 5,346,091 | 9/1994 | Hsu | 211/128 |
| 5,370,263 | 12/1994 | Brown | 248/210 |
| 5,743,416 | 4/1998 | Yemini | 211/70.6 |
| 5,823,363 | 10/1998 | Cassel | 211/60.1 |

FOREIGN PATENT DOCUMENTS

| | | | |
|---|---|---|---|
| 121430 | 5/1946 | Australia | 211/70.6 |
| 510942 | 10/1992 | European Pat. Off. | 211/184 |
| 2033732 | 5/1980 | Sweden | 211/70.6 |
| 1489463 | 10/1977 | United Kingdom | 211/70.6 |

*Primary Examiner*—Daniel P. Stodola
*Assistant Examiner*—Erica B. Harris
*Attorney, Agent, or Firm*—Price, Heneveld, Cooper, DeWitt & Litton

[57] ABSTRACT

A multiple use storage shelf for efficiently organizing and storing a variety of different sized items such as balls, ranging from golf balls to basketballs, and containers, ranging from a small box of nails to a larger paint can. The shelf, being of a one-piece construction; includes a first shelf supporting area located at the rearward portion of the shelf for supporting larger and heavier items and a reduced front area for supporting smaller items. The rear and front shelf areas are located at sufficiently different horizontal planes.

13 Claims, 4 Drawing Sheets

MULTIPLE USE STORAGE SHELF FOR ORGANIZING AND STORING SPORTING EQUIPMENT OR OTHER ARTICLES

This is a continuation of U.S. patent application Ser. No. 08/862,473, filed on May 23, 1997, entitled "MULTIPLE USE STORAGE SHELF FOR ORGANIZING AND STORING SPORTING EQUIPMENT OR OTHER ARTICLES" now abandoned.

BACKGROUND OF THE INVENTION

This invention relates to a storage shelf or rack and more specifically to a wall-mounted shelf with multiple applications including the organizing and storing of sporting goods such as different size balls, bats, and other articles or objects having different sizes such as workshop and gardener items.

BRIEF DESCRIPTION OF PRIOR ART

There has always been a need for ways to store balls and other objects of a variety of sizes. For example, a typical household with children have several balls of different sizes and use, such as basketballs, footballs, soccer balls, baseballs, tennis balls, and golf balls. The problem has been the inability to efficiently store such items so that they can be easily found when wanted, particularly with efficient use of space. Various racks have been designed, but to my knowledge all of them have one drawback and that is the lack of storage space for a variety of sizes of items such as all sizes of balls, workshop, and gardener items. The items being stored in a disorganized arrangement make it more difficult to store, locate, and/or remove the items from the rack.

Further, prior storage racks have been difficult to assemble and mount on the wall of the storage building such as a garage. Also, prior racks have been either expensive or incapable of storing a desired number of balls or other items.

Another drawback of many of the racks for storing balls is that such racks cannot be used for storing other items and as a result, such racks are of limited use.

SUMMARY OF THE INVENTION

The present invention provides a new and improved multiple use storage shelf, one application being the storage of sports equipment including various sizes of balls and ball bats. It also can be utilized for storing other articles of different sizes such as workshop and gardener items. The storage shelf, according to my invention, includes rear and front walls with side walls extending therebetween and located between the front and rear walls is an upright intermediate wall extending between the side walls. A first support surface is located between the rear, intermediate, and side walls to provide a first shelf area of a size for supporting larger items such as basketballs, soccer balls, footballs, larger paint cans, and flower pots. A second support surface is located between the intermediate and front walls to provide a second shelf area. This second shelf area is located at a lower level than the first support surface and is generally horizontally less deep than the first support surface to accommodate storage of smaller items such as baseballs, softballs, tennis balls, golf balls, smaller cans, and containers. The second support surface is located at a lower level so as not to interfere with the storage of the larger balls on the first support surface. Further, the different horizontal planes on which the first and second support surfaces are located are sufficiently different to promote better visibility and access to items stored on the upper shelf area. However, the shelf areas are close enough to the same horizontal level to optimize the efficient use of the depth of the space, taking up less vertical space than two shelves.

The initial construction of my shelf is of one-piece vacuum formed, shaped sheet of substantially equal thickness throughout. In other words, the wall of the panel has substantially the same thickness. The vacuum formed one-piece shelf is a relatively inexpensive construction that holds a number of balls or other items as opposed to prior racks which hold a small number of balls or are relatively expensive or they cannot be used for storing other items of different sizes.

My one-piece shelf has been designed so that the rear, front, intermediate, and side walls are all formed by spaced panel sections to give rigidity to those walls. Further, the entire shelf is reinforced by irregular shaped panel sections forming gussets or ribs that permit the shelf to be vacuum formed as a shaped sheet of relatively thin walls.

My shelf also includes projections extending endwise from the side walls. These projections including indented portions for receiving suspended articles such as the handle of a ball bat, hockey stick, hammer, hoe, or rake. These projections are reinforced by spaced sheet sections extending from one of the side walls to one of the projections and being molded integrally therewith.

Having briefly summarized my invention, reference is now made to the drawings and specification which will make clear the foregoing features and advantages of this invention.

DETAILED DESCRIPTION OF PREFERRED EMBODIMENT

Figure 1A:
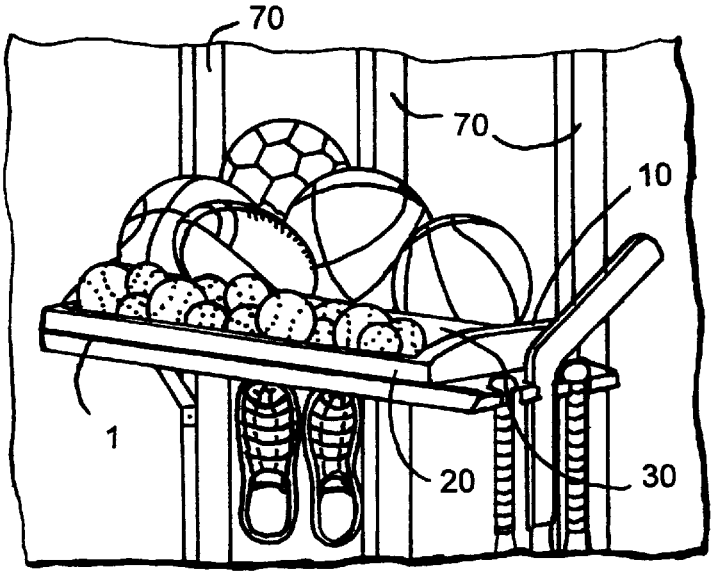
FIG. 1A discloses a perspective of the shelf of this invention with sporting goods mounted thereon.
Figure 1B:
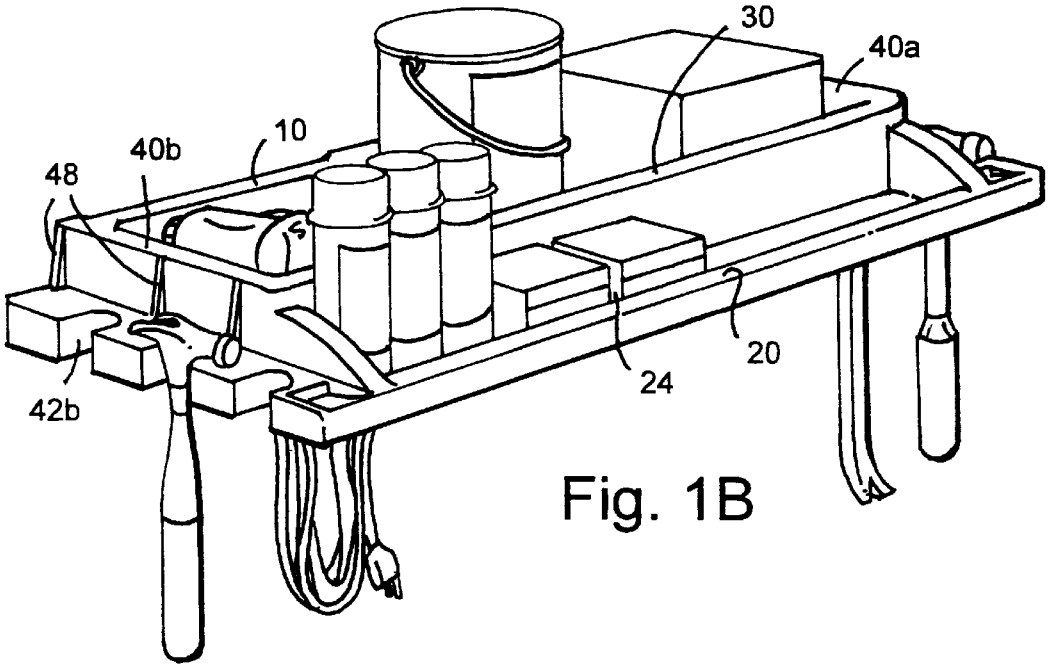
FIG. 1B discloses a perspective of the shelf storing workshop items.
Figure 1C:
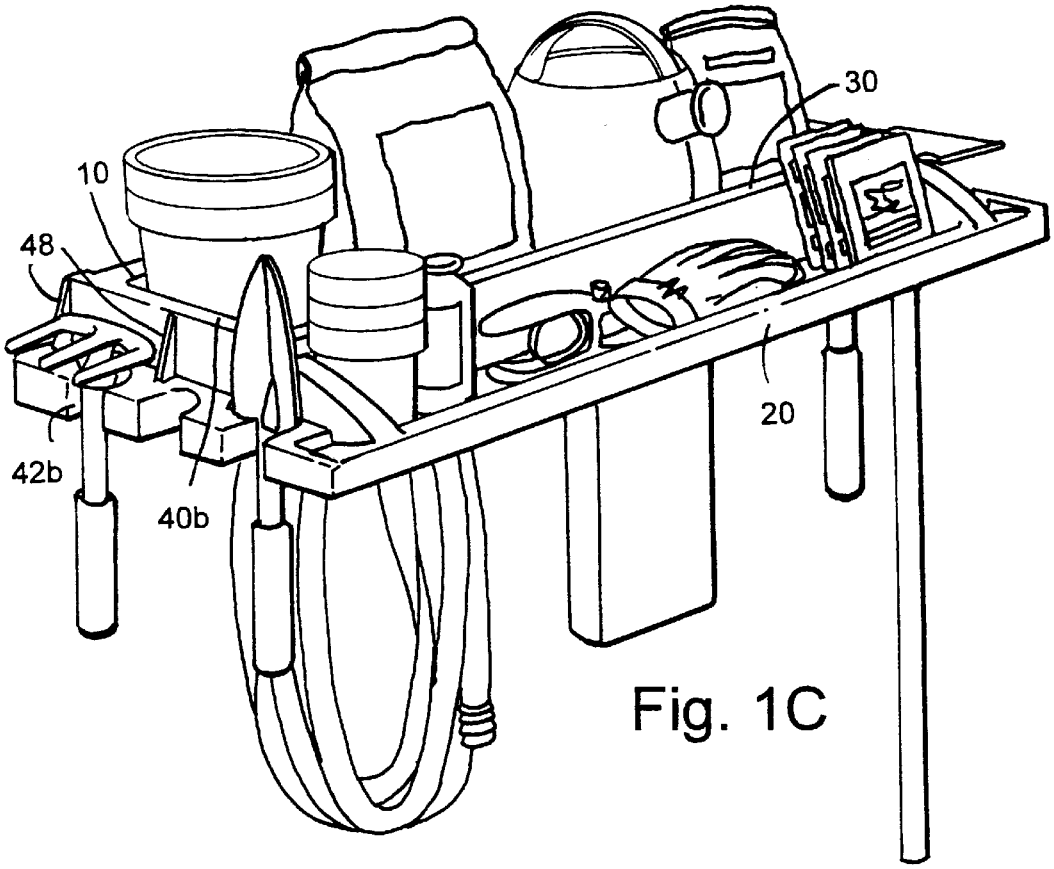
FIG. 1C discloses a perspective of the shelf storing gardener items.

Referring to the drawings, reference numeral 1 designates the shelf which includes the rear wall 10, the front wall 20, intermediate wall 30, and side walls 40*a* and 40*b*. A floor or first support surface 11 is located between the rear wall 10 and intermediate wall 30 to provide a first shelf area to support a plurality of larger items such as basketballs, soccer balls, and footballs (FIG. 1A), larger workshop items such as paint cans (FIG. 1B), or larger gardening items such as flower pots (FIG. 1C). A floor 21 or second support surface 21 provides a second shelf area for supporting a plurality of sport items such as baseballs, tennis balls, softballs, golf balls, or smaller workshop or gardening items. As disclosed in FIGS. 2, 5, and 6, the support surface 21 is located on a lower level or plane than the first surface 11. Thus, as disclosed in FIG. 5, there is no interference between the larger balls 3 and located in the first shelf area and the smaller balls 4 located in the second shelf area. In fact, due to their mutual orientation, the balls share some vertical space, illustrated by broken line 61, which optimizes efficient use of space. Further, the larger shelf area supports the heavier items while the smaller shelf area at the front supports smaller, lighter items to promote better loading so that a lighter shelf can be utilized. Protrusions 41*a* and 41*b* extend sidewise from the side walls 40*a* and 40*b*, respectively. These protrusions or projections include the indentations 42*a* and 42*b*, respectively, for receiving the handle end of ball bats, hockey sticks and elongated items as disclosed in FIGS. 1A, 1B, and 1C.

As previously disclosed under the "Summary Of The Invention," shelf 1 can be vacuum formed preferably of a plastic sheet of material generally known as a high density polyethylene. Therefore, the shelf is formed of a shaped sheet of such material so as to be substantially of the same thickness throughout the cross section of the shelf. This is disclosed in FIGS. 5 and 6.

Figure 5:
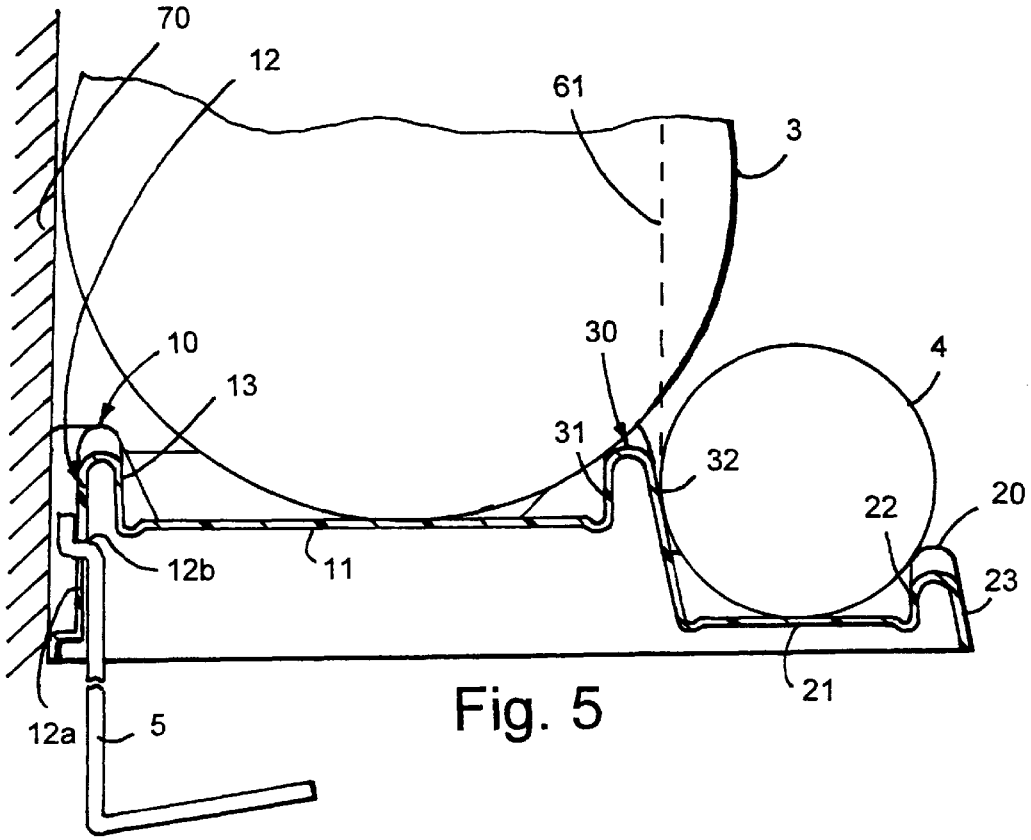
FIG. 5 is a cross-sectional view taken along the plane V—V of FIG. 2.
Figure 6:
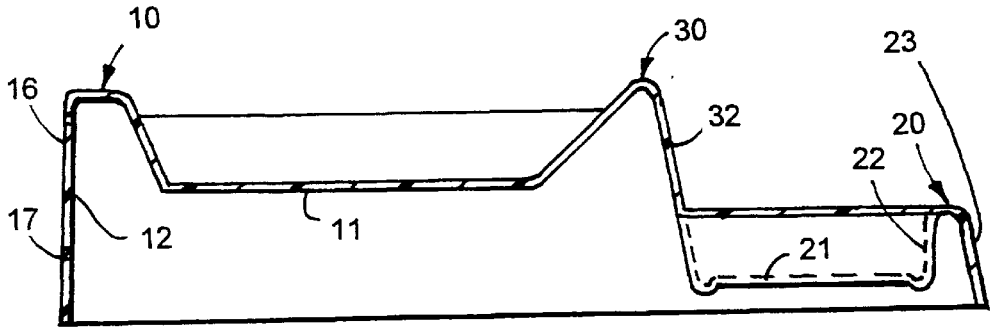
FIG. 6 is a cross-sectional view taken along the plane VI—VI of FIG. 2.

Referring to FIGS. 5 and 6, it will be noted that the rear wall 10 is formed of a shaped section of the plastic sheet and includes the wall section 12 and wall section 13 spaced one from the other to form the rear wall 10. Similarly, front wall 20 includes a shaped sheet section formed by the spaced wall sections 22 and 23. Also, intermediate wall 30 is formed of a shaped section of the sheet material so as to provide the wall section 31 spaced from the wall section 32.

Figure 2:
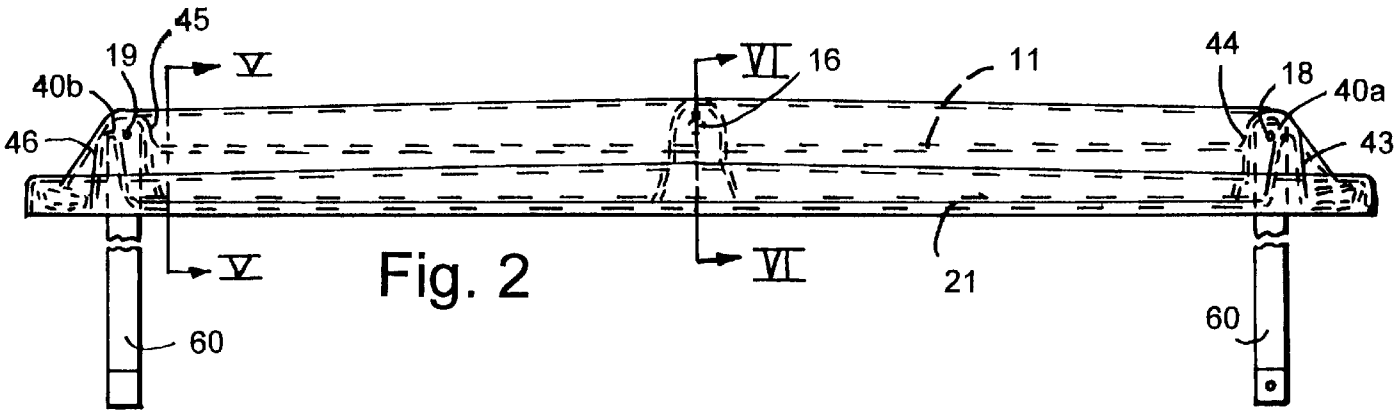
FIG. 2 is a front elevational view of the shelf.

As shown in FIG. 2, the side walls 40*a* and 40*b* also are formed by shaped sheet sections. Side wall 40*a* includes the spaced wall sections 43 and 44 and side wall 40*b* being formed by the wall sections 45 and 46.

Figure 3:
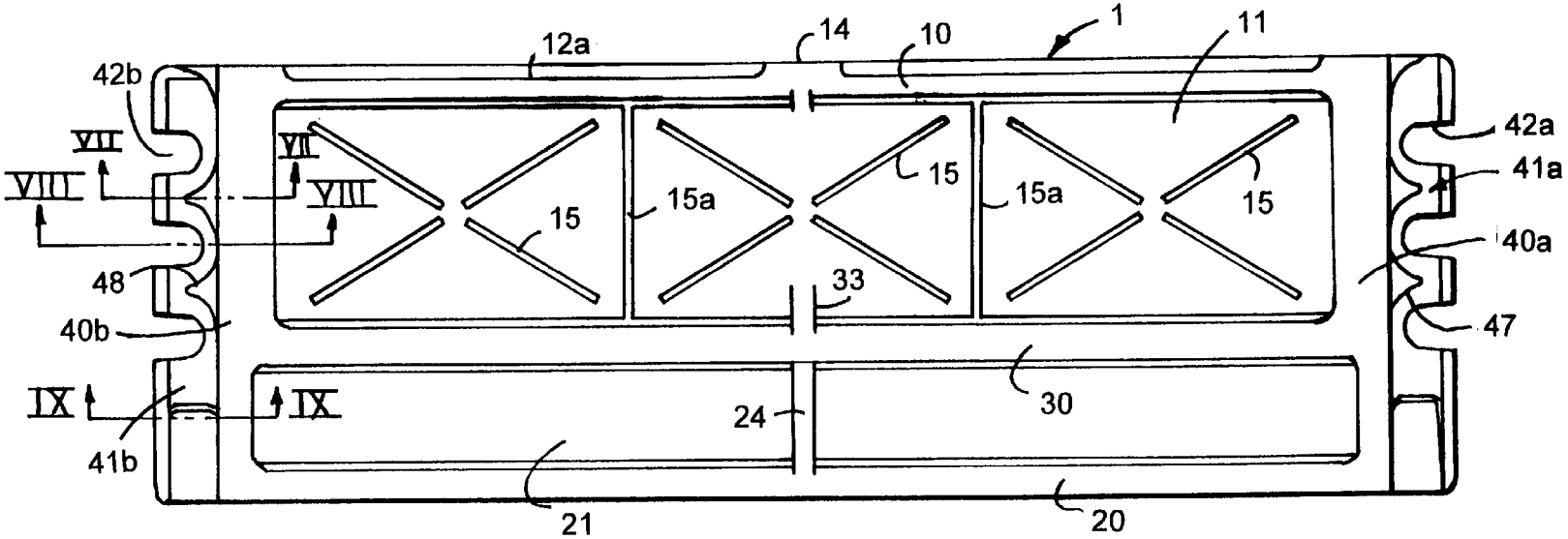
FIG. 3 is a top plan view of the shelf.
Figure 7:
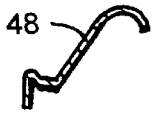
FIG. 7 is a cross-sectional view taken along the plane VII—VII of FIG. 3.
Figure 8:
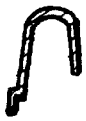
FIG. 8 is a cross-sectional view taken along the plane VIII—VIII of FIG. 3.
Figure 9:
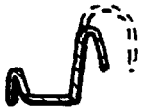
FIG. 9 is a cross-sectional view taken along the plane IX—IX of FIG. 3.

As shown in FIG. 3, the shelf is reinforced at various locations by shaped sheet sections forming reinforcement ribs. Specifically, rear wall 10 is reinforced by rib 14. Front wall 20 is reinforced by rib 24 and intermediate wall 30 is reinforced by rib 33. The protrusions or projections 41*a* and 41*b* are reinforced by the ribs 47 and 48, respectively, the cross sections of which are illustrated by FIG. 7, which is a cross section through one of the ribs 48. It will be noted that this rib 48 extends from the protrusion 41*b* upwardly to the top end of the side wall 40*b*. The floor or support surface 11 is also reinforced by the ribs 15 and 15*a* as disclosed in FIG. 3.

The rear wall 10 is constructed with wall section 12 including portions 12*a* which are spaced from the wall 70 (FIG. 5). These portions include one or more openings 12*b* for receiving the hook on which any number of items can be hung.

The shelf 1 requires no assembly and is adapted to be mounted on a vertical wall which generally, in most garages and sheds or other storage area includes vertically extending studs 70 (FIG. 1A) which are generally located 16 inches apart. As shown in FIGS. 2 and 6, the shelf includes a key hole 16 located at the upper end of the wall section 12 of the rear wall 10 and a second hole 17 or opening located immediately below keyhole 16. Both the keyhole 16 and hole 17 are located on the centerline of the shelf. Further, openings or holes 18 and 19 are located in the rearward ends of the side walls 40*a* and 40*b*.

Figure 4:
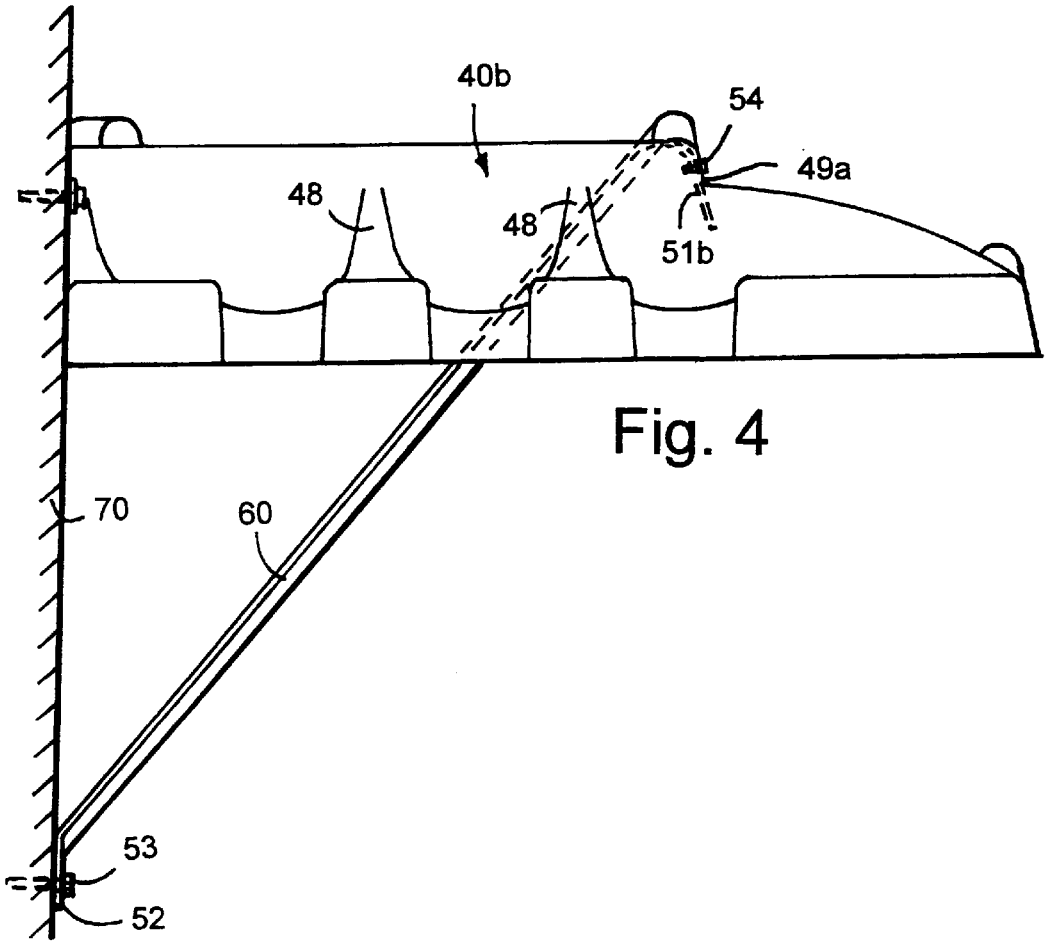
FIG. 4 is a side elevational view of the shelf also disclosing a brace for assisting and the support of the same.

The first step in mounting the shelf is to locate the desired center stud 70 on which the shelf is to be mounted. Then the desired location of the top of the shelf is established and a screw is inserted in the center stud at a height location for receiving the screw through the keyhole. The screw is screwed in approximately 1/16 inch in from being fully seated. The shelf is then mounted on the screw and leveled after which a second screw is inserted and screwed into the stud through the opening 17. The next step is then to insert and screw the screws into the studs at both ends through the openings 18 and 19. Then next step is to install the braces 60 which are inserted between the two walls 43 and 44 of side wall 40*a* and walls 45 and 46 of side wall 40*b*. As disclosed in FIG. 4, the end 51*b* of brace 60 abuts against the surface 49*a* of the side wall 40. The other end 52 is mounted by screw 53 to one of the studs of the wall. If desired, a fastener 54 helps to retain the end 5 lb in abutting relationship with the surface 49*a*.

Having described my invention by its best mode, it should be understood that the disclosed details are exemplary only and are not to be taken as limitations on the invention except as those details may be included in the appended claims.

What is claimed is:

1. A storage one-piece shelf comprising:

rear and front walls with side walls extending therebetween;

an upright intermediate wall located between said front and rear walls and extending between said side walls;

a first support surface bounded by said rear, intermediate, and side walls to provide a substantially planar first shelf area;

said rear and intermediate walls and first portions of said side walls extending above said first support surface a sufficient distance for containing and holding articles therebetween above the first support surface;

a second support surface bounded by said intermediate, front, and side walls to provide a substantially planar second shelf area;

said intermediate and front walls and second portions of said side walls extending above said second support surface a sufficient distance for containing articles therebetween; and said second support surface being located at a lower level than said first support surface to increase the visibility and accessibility of articles supported on the first support surface; said shelf areas being formed by an integral one-piece shelf wherein said one-piece shelf is formed as a shaped sheet of plastic material of substantially equal thickness throughout.

2. The storage shelf of claim 1 which said first shelf area is of a size to support larger items and said second shelf area is a size smaller than said first area for supporting smaller and lighter items.

3. The storage shelf of claim 1 in which projections extend endwise from the said side walls; said projections including indented portions for receiving suspended articles and said projections are formed as one-piece with said shelf areas.

4. The storage shelf of claim 1 in which projections extend endwise from the said side walls; said projections including indented portions for receiving suspended articles.

5. The storage shelf of claim 4 in which each of said projections is supported and reinforced by a flange integrally molded to the outer side of one of said side walls and extending from said one of said side walls to one of said projections to which it is integrally molded.

6. The storage shelf of claim 1 in which the distance between said rear and intermediate walls is greater than the distance between said intermediate and front walls whereby the first shelf area is horizontally deeper than said second shelf area to accommodate storage of larger items than said second shelf area.

7. The storage shelf as defined in claim 6 in combination with a plurality of balls of different sizes including first balls stored on said first support surface; said first balls including portions thereof extending over said intermediate wall above said second support surface, and second balls of smaller diameter than said first balls, said second balls supported on said second support surface below the first ball portions which extend over said second support surface; said lower level of said second support surface being located below said first support surface a distance which in relation to the distance between the intermediate wall and front wall and the distance said front wall extends upwardly from said second support surface permits the second balls to have a diameter sufficiently large to engage the second support surface, the intermediate wall and front wall without engaging the first balls.

8. The storage shelf of claim 1 in which said rear, front, intermediate, and side walls are formed by spaced sections of said shaped sheet.

9. The storage shelf of claim 8 in which wall attachments are provided for attaching said rear wall to an upright support wall and braces are provided having one end extending between the shaped sheet sections forming said side walls and another end secured to said support wall.

10. The storage shelf of claim 8 in which said shelf is reinforced by irregular shaped sheet sections forming reinforcement ribs.

11. The storage shelf of claim 10 in which one of said reinforcement ribs is formed between said front and intermediate walls and is located between said side walls.

12. The storage shelf of claim 10 in which projections extend endwise from the said side walls; said projections including indented portions for receiving suspended articles.

13. The storage shelf of claim 12 in which said reinforcement ribs are formed between said projections and side walls.

* * * * *